US009321563B1

(12) United States Patent
Bowlin

(10) Patent No.: US 9,321,563 B1
(45) Date of Patent: Apr. 26, 2016

(54) COFFEE CUP LID HOLDER

(71) Applicant: Patrick Bowlin, Philadelphia, PA (US)

(72) Inventor: Patrick Bowlin, Philadelphia, PA (US)

( * ) Notice: Subject to any disclaimer, the term of this patent is extended or adjusted under 35 U.S.C. 154(b) by 0 days.

(21) Appl. No.: 14/547,815

(22) Filed: Nov. 19, 2014

(51) Int. Cl.
*B65D 43/10* (2006.01)
*B65D 43/02* (2006.01)
*B65D 43/06* (2006.01)
*A47G 19/22* (2006.01)

(52) U.S. Cl.
CPC ..... *B65D 43/0208* (2013.01); *B65D 43/065* (2013.01); *B65D 2543/00833* (2013.01)

(58) Field of Classification Search
CPC ..... B65D 55/16; B65D 2543/00046; B65D 43/0208; B65D 43/065; B65D 2543/00833; A47J 36/12
USPC ..... 220/780, 379, 375, 712, 713; 215/390, 215/399
See application file for complete search history.

(56) References Cited

U.S. PATENT DOCUMENTS 2,300,076 A * 10/1942 Ueda ..... A47J 36/12 220/379
2,879,915 A * 3/1959 Medor ..... A47J 36/12 220/744
3,900,106 A * 8/1975 Cantales ..... B65D 45/20 206/519
4,054,221 A * 10/1977 Glover ..... B65D 55/16 215/235
6,247,608 B1 * 6/2001 Chang ..... B65D 17/165 220/269
7,175,043 B2 * 2/2007 O'Neal ..... B65D 43/0212 220/212
7,419,067 B2 * 9/2008 Bouie ..... B65D 1/265 220/375
7,673,767 B2 * 3/2010 Vovan ..... B65D 21/0237 220/212
8,424,711 B2 * 4/2013 Charbonnet ..... B65D 43/0208 220/703
8,464,896 B2 * 6/2013 Beary ..... A47G 19/2222 220/705
8,561,834 B2 10/2013 Ziegler

* cited by examiner

*Primary Examiner* — J. Gregory Pickett
*Assistant Examiner* — Niki M Eloshway
(74) *Attorney, Agent, or Firm* — Joseph E. Maenner; Maenner & Associates, LLC

(57) ABSTRACT

A holder for supporting a lid on an outside of a cup is disclosed. The holder includes an extension portion adapted to secure to the lid and a curved cup engagement portion extending from the extension portion. The holder can be integrated onto a lid. A method for securing the lid to a cup is also provided.

15 Claims, 5 Drawing Sheets

COFFEE CUP LID HOLDER

BACKGROUND OF THE INVENTION

1. Field of the Invention

The present invention relates to a holder to support a lid on the side of a coffee cup.

2. Description of the Related Art

Many stores that provide drinks to customers in paper or cardboard cups with a removable lid also provides stations for the customers to add additional ingredients to the drink, such as, for example, cream and/or sugar. In order for the customer to add these ingredients, however, the customer must remove the lid and placed the lid down on a counter or other surface. Such surfaces may be laden with bacteria that are then transferred to the lid and then possibly to the customer.

It would be beneficial to provide a device that allows the customer to remove the lid from the cup and secure the lid to the cup in such a way that the lid is out of the way, allowing the customer to add the desired ingredients to his/her drink, thereby reducing the risk of contamination of the lid.

BRIEF SUMMARY OF THE INVENTION

Briefly, the present invention provides a holder for supporting a lid on an outside of a cup. The holder comprises an extension portion adapted to secure to the lid and a curved cup engagement portion extending from the extension portion.

Additionally, the present invention provides a lid assembly for a cup. The cup has an annular bead extending around an outer periphery thereof. The lid comprises a lid having an annular passage extending around a periphery thereof. The annular passage is sized to releasably grip the annular bead. A lid holder is attached to the lid. The lid holder comprises an extension portion extending away from the lid and a curved cup engagement portion extending from the extension portion, distal from the lid.

Further, the present invention provides a method of securing a lid to a cup. The method comprises providing the lid assembly described above, the cup having an annular bead extending around an outer periphery thereof; removing the lid assembly from the cup; moving the lid assembly relative to the cup such that the lid is not vertically over the cup; placing the curved cup engagement portion over the bead; and forcing the curved cup engagement portion downwardly over the bead.

BRIEF DESCRIPTION OF THE DRAWINGS

The accompanying drawings, which are incorporated herein and constitute part of this invention, illustrate the presently preferred embodiments of the invention, and, together with the general description given above and the detailed description given below, serve to explain the features of the invention. In the drawings.

DETAILED DESCRIPTION OF THE INVENTION

Figure 1:
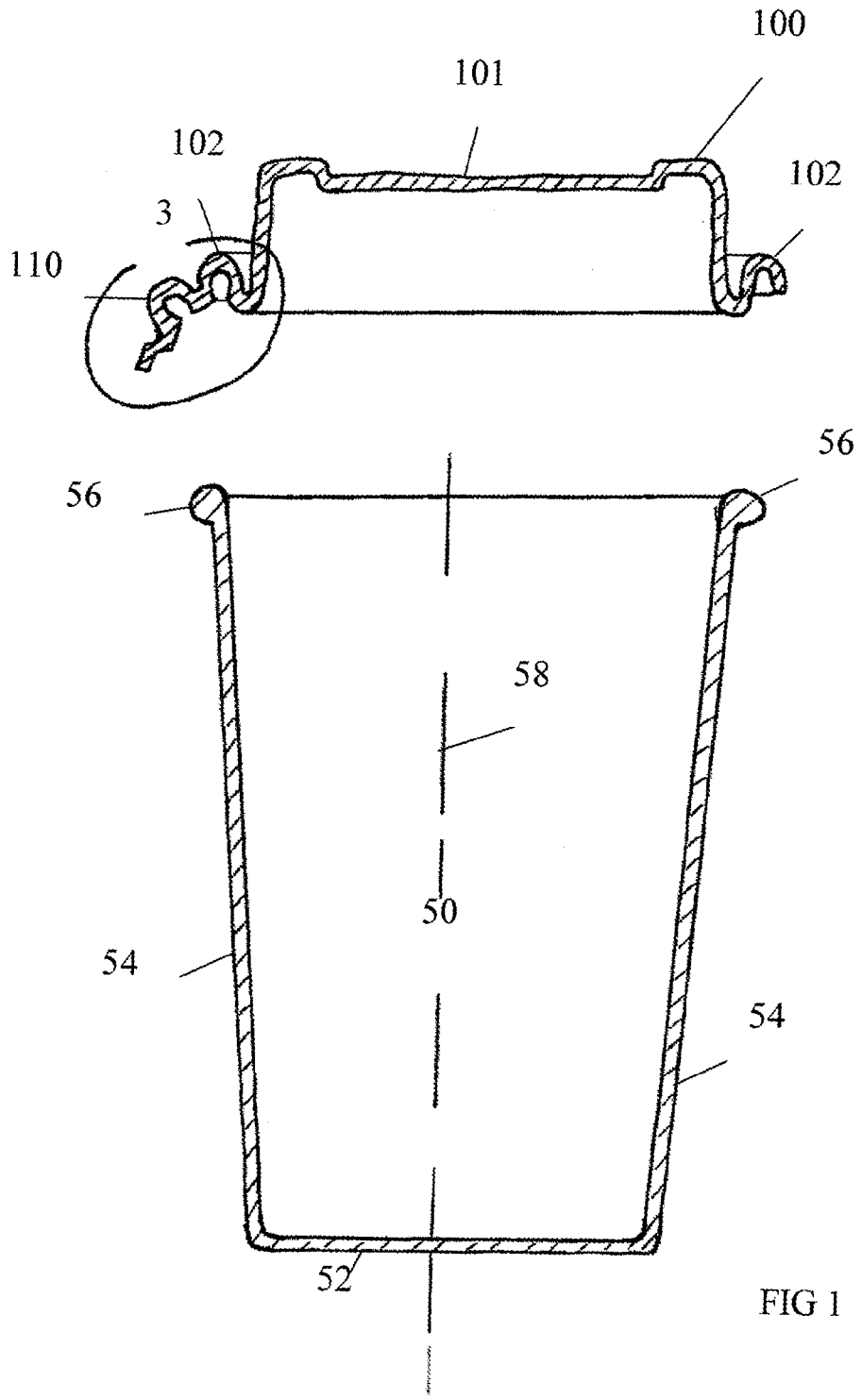
FIG. 1 is a sectional view of a lid assembly according to a first exemplary embodiment of the present invention for use with a cup.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, "inner" or "inward" refers to a direction toward a longitudinal axis of a cup, and "outer" or "outward" refers to the opposite direction. "Upper" refers to a direction along the longitudinal axis from the cup upward, toward the lid, and "lower" refers to the opposite direction, and above or below are with reference to the relative positions along the longitudinal axis of the cup using the same orientation as "upper" and "lower." The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

One embodiment of the present invention is a holder that may be employed with a lid of a conventional disposable cup for a beverage container having a bead located about the periphery of an opening of the cup. A cup lid having an annular recess engages with the cup bead. The holder extends outwardly from the annular recess and allows a user to remove the cup lid from the cup and secure the lid to the cup while exposing the open top of the cup.

Referring to FIG. 1, cup 50 has a bottom 52, sidewalls 54 and a bead 56 around the periphery or open top of cup 50. Cup 50 includes a longitudinal axis 58 extending therethrough. Sidewalls 54 are typically tapered at a slight angle to allow stacking of a plurality of cups 50, although the present invention may be employed in lids for cups that do not have angled sidewalls 54. Cup 50 may be of the disposable type of cups, which are typically made of paper with a rolled bead 56 as shown, or they can be made of various plastic materials with a rolled bead or solid bead. Beads 54 typically have a generally circular cross-section, and that includes beads 54 with an oval shape as formed or as deformed during stacking and shipping, and that includes beads 54 with a rounded upper edge and a slightly flattened outer facing edge, or even a slightly flattened bottom edge. In addition, the present invention may be used with lids for cups having beads 54 that comprise a flange, projection, or any non-circular cross-section, and with cups may not be disposable.

A closure, or lid assembly 100, releasably fastens to the top of cup 50. In an exemplary embodiment, lid assembly 100 is made of thin, vacuum formed plastic, typically styrene, and is typically about 0.015-0.020 inches thick. However, it will be appreciated that lid assembly 100 may be made of biodegradable materials, and other materials, such as polymers, polyesters, polyolefins, polycarbonates, polyamides, polyethers, polyethylene, polytetrafluoroethylene, silicone, silicone rubber, polyurethane, polyvinyl chloride, polystyrene, stainless steel, aluminum alloys, and metal alloys.

Figure 2:
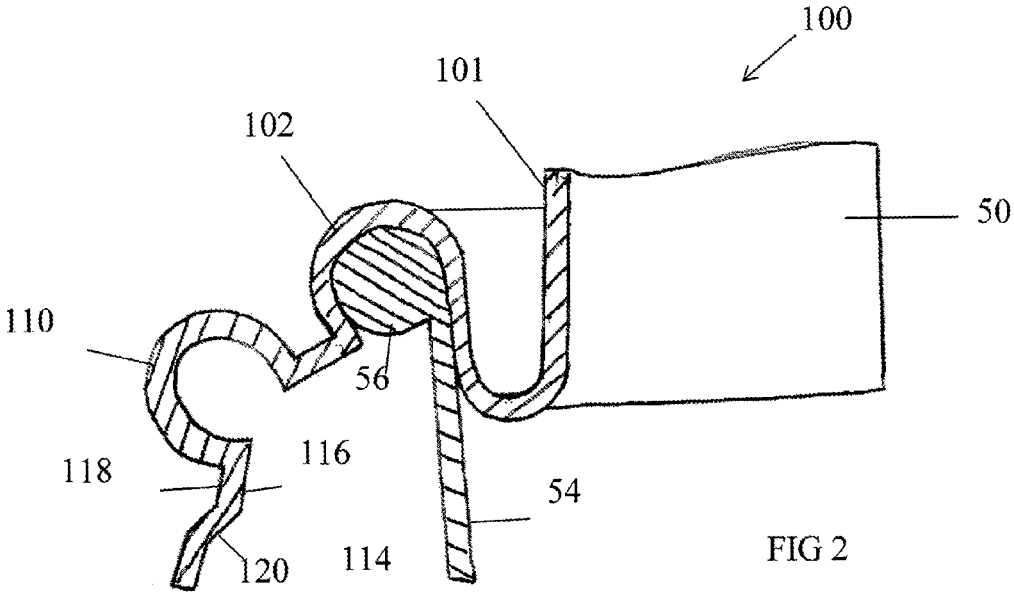
FIG. 2 is a sectional view of an inventive portion of the lid assembly according to the first exemplary embodiment of the present invention attached to the cup.

Lid assembly 100 includes a lid 101 that has an annular passage 102 extending 360 degrees around a periphery thereof. Annular passage 102 is sized to releasably grip annular bead 56, as shown in FIG. 2. A lid holder 110 is attached to lid 101 and extends outwardly from lid 101. Unlike annular passage 102 that extends 360 degrees around lid 101, lid holder 110 extends only partially around lid 101, such as, for example, about 15 degrees.

Figure 3:
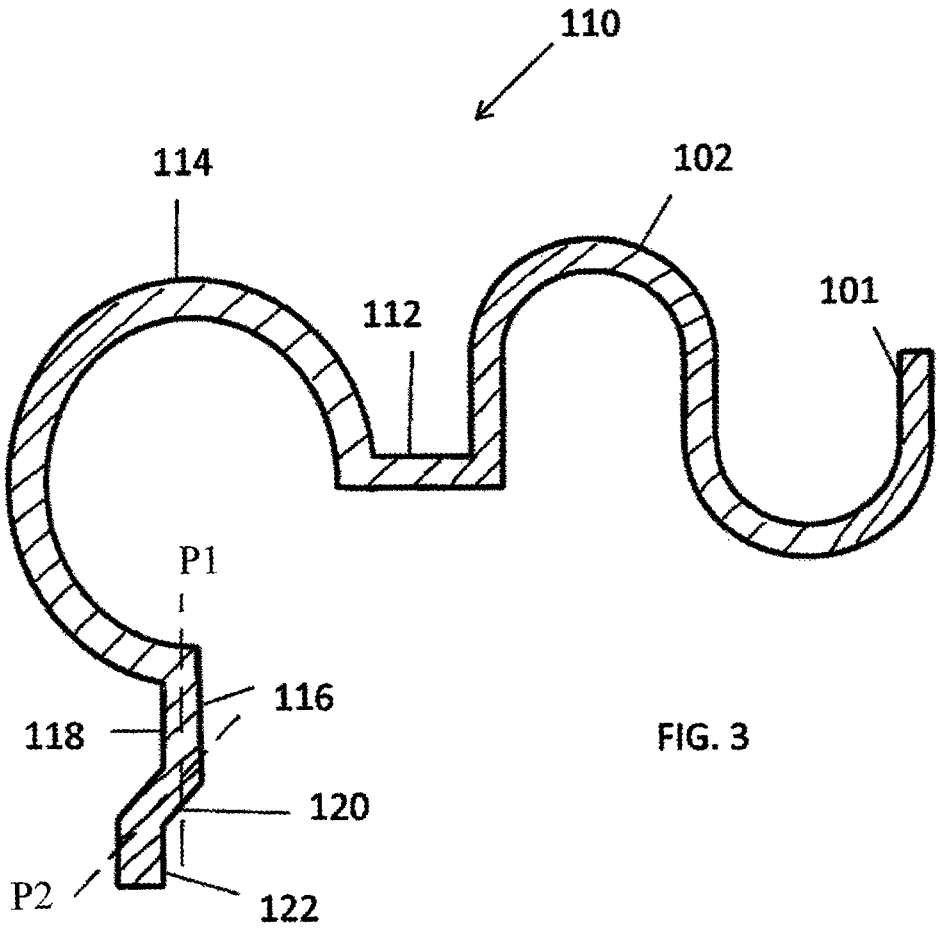
FIG. 3 is an enlarged version of a lid holder portion of the lid assembly shown in FIG. 1, taken along line 3 of FIG. 1.
Figure 4:
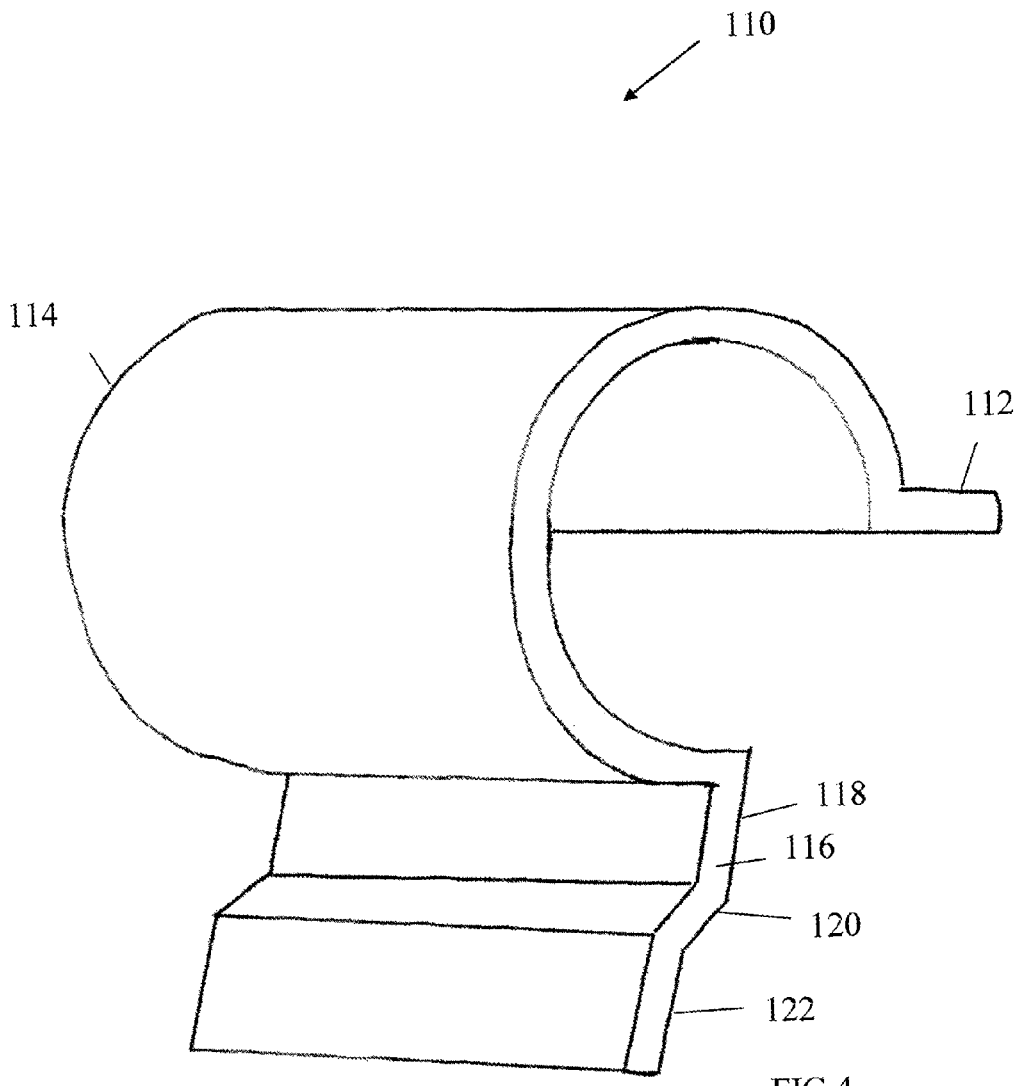
FIG. 4 is a first perspective view of the lid holder according to the present invention, without the lid.
Figure 5:
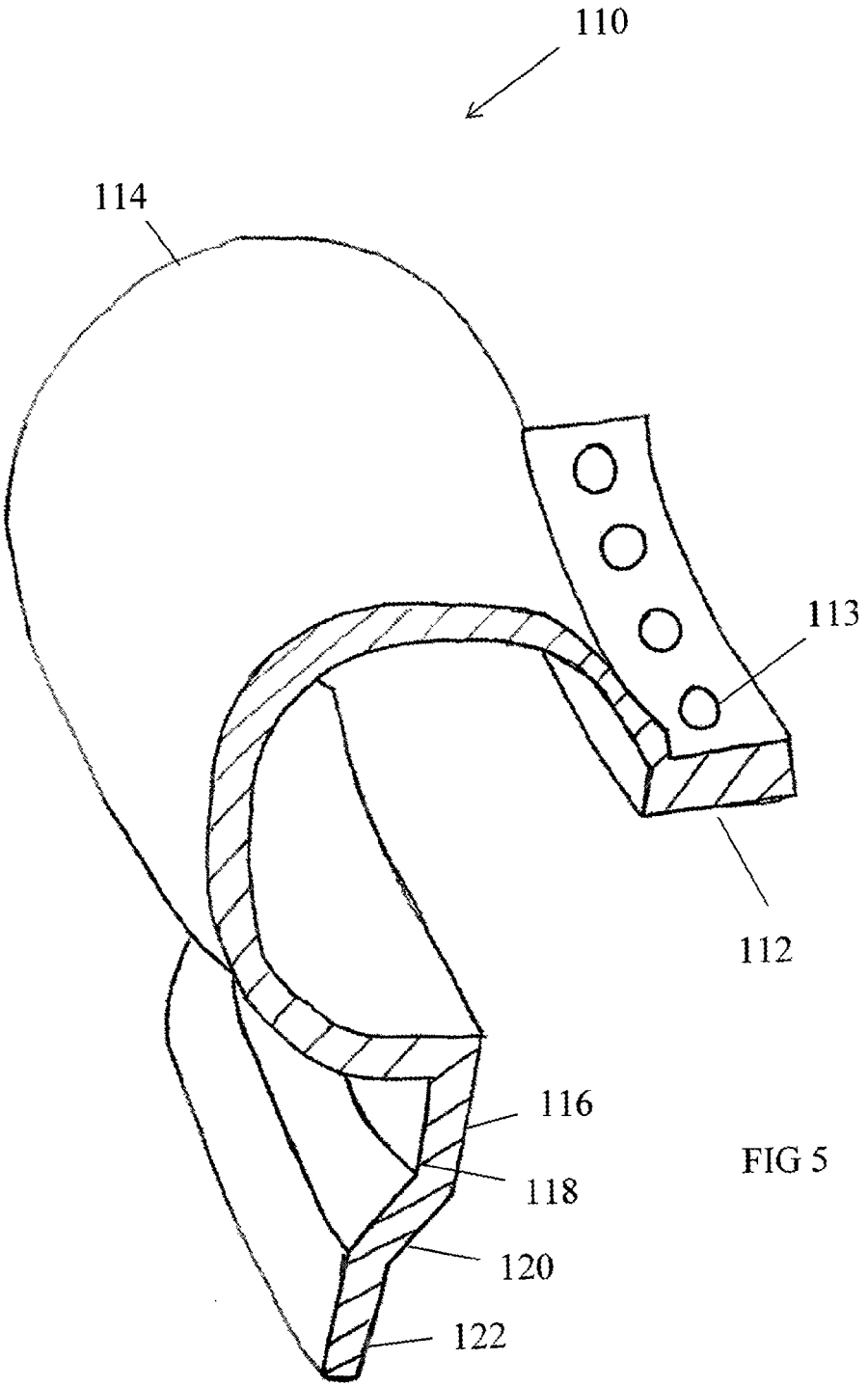
FIG. 5 is a second perspective view of the live holder according to the present invention, without the lid.

Referring to FIGS. 3-5, lid holder 110 includes an extension portion 112 extending away from lid 101 (for clarity, lid 101 is only shown in FIG. 3). Extension portion 112 extends in a plane, with a perforation 113 extending therealong. Perforation 113 is shown in FIG. 5 as a plurality of holes formed through extension portion 112, thereby weakening extension portion 112 and allowing lid holder 110 to be easily separated from lid 101, such as by tearing.

A curved cup engagement portion 114 extends from extension portion 112, distal from lid 101. In an exemplary embodiment, curved cup engagement portion 114 defines an arc $\alpha$ greater than 180 degrees and, in an alternative exemplary embodiment, curved cup engagement portion 114 defines an arc $\alpha$ of about 270 degrees.

A lift tab 116 extends from curved cup engagement portion 114, distal from extension portion 112. Lift tab 116 comprises a connecting portion 118 connected to curved cup engagement portion 114, an offset portion 120 connected to connecting portion 118, distal from curved cup engagement portion 114, and a grip portion 122 connected to offset portion 120, distal from connecting portion 118.

Connecting portion 118 extends in a first plane P1 extending perpendicularly from the plane of the paper of FIG. 3 and offset portion 120 extends in a second plane P2 extending perpendicularly from the plane of the paper of FIG. 3 at an angle oblique to first plane P2. Grip portion 122 extends in a third plane P3 extending perpendicularly from the plane of the paper of FIG. 3 at an angle oblique to second plane P2. Third plane P3 extends generally parallel to first plane P1.

While FIGS. 1-3 show and describe lid holder 110 as an integral part of lid assembly 100, those skilled in the art will recognize that lid holder 110 can be formed separately from lid 101 and attached to lid 101 at a later time. Lid holder 110 can be secured to lid 101 by known means such as, but not limited to, adhesive, ultrasonic welding, or other known processes.

Figure 6:
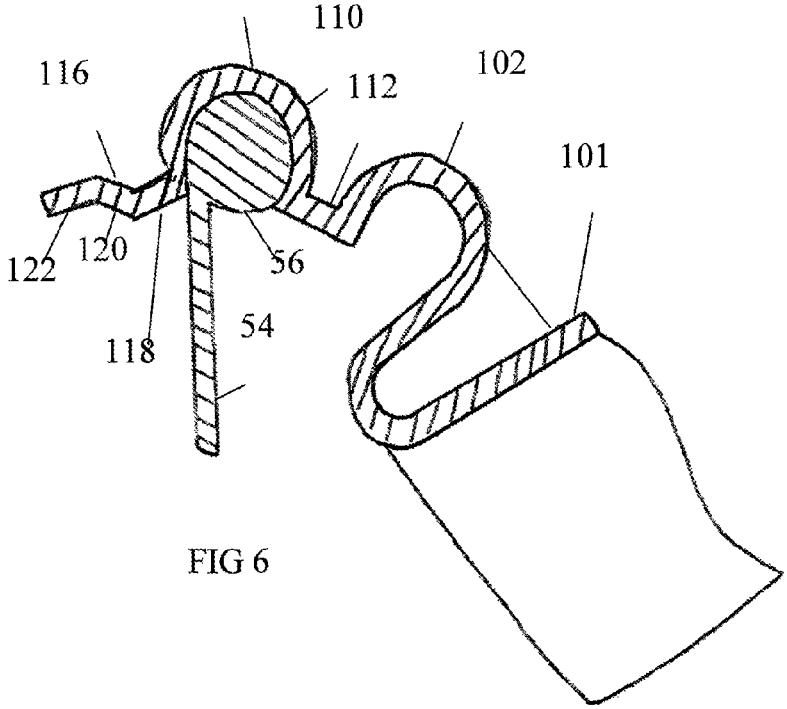
FIG. 6 is a sectional view of the inventive portion of the lid assembly according to the first exemplary embodiment of the present invention with the lid holder engaging the cup.

An exemplary method of using lid assembly 100 will now be described. Lid assembly 100 can be provided on cup 50, as is standard when a customer receives cup 50 from a vendor. When the customer desires to add ingredients, such as, for example, sugar and or cream to the drink in cup 50, the customer removes lid assembly 100 from cup 50 and moves lid assembly 100 relative to cup 50 such that lid 101 is not vertically over cup 50. The customer places curved cup engagement portion 114 over bead 56, such that lid 101 is outside the cup and lift tab 116 extends within the perimeter of the cup. The customer then forces curved cup engagement portion 114 downwardly over bead 56 to the position shown in FIG. 6.

After the user has added the desired ingredients, the user can grip lift tab 116 and pull lift tab 116 upwardly, opening up curved cup engagement portion 114, and allowing lid holder 110 to be separated from bead 56 so that lid assembly 100 can be removed from cup 50.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A combination lid and holder for supporting the lid on an outside of a cup, the combination comprising:

the lid having an annular passage extending continuously around an outer perimeter thereof, the passage sized to grip a rim of the cup; and the holder having:

a. an extension portion extending outwardly from the outer perimeter of the lid;

b. a curved cup engagement portion extending from the extension portion, the curved cup engagement portion being sized to grip the rim of the cup; and c. a lift tab extending from the curved cup engagement portion, distal from the extension portion, wherein the lift tab comprises a connecting portion connected to the curved cup engagement portion, an offset portion connected to the connecting portion, distal from the curved cup engagement portion, and a grip portion connected to the offset portion, distal from the connecting portion.

2. The holder according to claim 1, wherein the connecting portion extends in a first plane and wherein the offset portion extends in a second plane extending at an angle oblique to the first plane.

3. The holder according to claim 2, wherein the grip portion extends in a third plane extending at an angle oblique to the second plane.

4. The holder according to claim 2, wherein the grip portion extends in a third plane extending generally parallel to the first plane.

5. The holder according to claim 1, wherein the curved cup engagement portion defines an arc greater than 180 degrees.

6. The holder according to claim 5, wherein the curved cup engagement portion defines an arc of about 270 degrees.

7. The holder according to claim 1, wherein the extension portion extends in a plane.

8. A lid assembly for a cup, the cup having an annular bead extending around an outer periphery thereof, the lid comprising:

a. a lid having an annular passage extending contiguously around a periphery thereof, the annular passage sized to releasably grip the annular bead; and b. a lid holder attached to the lid, the lid holder extending outwardly from the periphery of the lid only partially around the periphery of the lid, the lid holder comprising:

i. an extension portion extending away from the lid;

ii. a curved cup engagement portion extending from the extension portion, distal from the lid, wherein the curved cup engagement portion defines an arc greater than 180 degrees and is sized to releasably grip the annular bead; and iii. a lift tab extending from the curved cup engagement portion, distal from the extension portion, wherein the lift tab comprises a connecting portion connected to the curved cup engagement portion, an offset portion connected to the connecting portion, distal from the curved cup engagement portion, and a grip portion connected to the offset portion, distal from the connecting portion, wherein the extension portion, the cup engagement portion, the connecting portion, the offset portion, and the grip portion all pass through a common plane.

9. The lid assembly according to claim 8, wherein the connecting portion extends in a first plane and wherein the offset portion extends in a second plane extending at an angle oblique to the first plane.

10. The lid assembly according to claim 9, wherein the grip portion extends in a third plane extending at an angle oblique to the second plane.

11. The lid assembly according to claim 10, wherein the grip portion extends in a third plane extending generally parallel to the first plane.

12. The lid assembly according to claim 8, wherein the curved cup engagement portion defines an arc of about 270 degrees.

13. The lid assembly according to claim 12, wherein the extension portion extends in a plane.

14. The lid assembly according to claim 8, wherein the extension portion has a perforation extending therealong.

15. A method of securing a lid to a cup, the method comprising:

a. providing the lid assembly according to claim 8 on a cup, the cup having an annular bead extending around an outer periphery thereof;

b. removing the lid assembly from the cup;

c. moving the lid assembly relative to the cup such that the lid is not vertically over the cup;

d. placing the curved cup engagement portion over the bead; and e. forcing the curved cup engagement portion downwardly over the bead.

* * * * *